US006006064A

United States Patent [19]

Hashimoto

[11] Patent Number: 6,006,064

[45] Date of Patent: Dec. 21, 1999

[54] ORIGINAL COVER CLOSER

[75] Inventor: Takayuki Hashimoto, Kanagawa, Japan

[73] Assignee: Katoh Electrical Machinery Co., Ltd., Kanagawa, Japan

[21] Appl. No.: 09/157,488

[22] Filed: Sep. 21, 1998

[30] Foreign Application Priority Data

Sep. 24, 1997 [JP] Japan ..... 9-258060

[51] Int. Cl.[6] ..... G03G 15/00

[52] U.S. Cl. ..... 399/380

[58] Field of Search ..... 399/380, 379, 399/377, 367; 355/75

[56] References Cited

U.S. PATENT DOCUMENTS

| | | | |
|---|---|---|---|
| 4,355,887 | 10/1982 | Sorimachi et al. | 355/25 |
| 4,365,893 | 12/1982 | Kimura et al. | 355/75 |
| 4,530,598 | 7/1985 | Kajita et al. | 355/75 |
| 4,853,750 | 8/1989 | Murata et al. | 355/75 |
| 5,003,347 | 3/1991 | Kameda | 355/75 |
| 5,110,103 | 5/1992 | Miyoshi et al. | 271/3.18 |
| 5,126,787 | 6/1992 | Irie et al. | 355/75 |
| 5,541,712 | 7/1996 | Fujitaka et al. | 399/380 |
| 5,621,501 | 4/1997 | Matsuo et al. | 355/75 |
| 5,748,293 | 5/1998 | Crawford et al. | 355/75 |

*Primary Examiner*—Robert Beatty

*Attorney, Agent, or Firm*—Notaro & Michalos P.C.

[57] ABSTRACT

In an original cover closer adapted to support an original cover used on a copying machine and on which an automatic document feeder is provided, including two types of original cover closers different in construction from each other.

9 Claims, 5 Drawing Sheets

ORIGINAL COVER CLOSER

BACKGROUND OF THE INVENTION

1. Field of the Invention

The present invention relates to an original cover closer for use on a copying machine or printing machine (will be referred to simply as "copying machine" hereinafter), and more particularly, to a closer for an original cover on which a heavy automatic document feeder is provided.

2. Description of the Prior Art

To copy a thick original such as a book, a well-known original cover closer comprises a mounting member to be installed on a copying machine body, a supporting member pivotably supported on the mounting member, a lifting member pivotably supported on a free end of the supporting member and to which the original cover is secured at the rear portion thereof, a resilient member provided between the mounting member and the free end of the supporting member, and a controlling member which controls the motion (turn) of the lifting member away from the supporting member.

Conventionally, in case a heavy automatic document feeder is additionally provided on the original cover and its center of gravity lies at the middle between the right and left of the original cover, a single large-torque closer is used with the original cover to support the latter at the middle portion thereof where the center of gravity, namely, the most of the weight, of the automatic document feeder is applied.

FIG. 1 shows the basic concept of the present invention will be outlined below. The original cover with which the closer of the present invention is used is generally indicated with a reference 1. It has a center of gravity 2. An automatic document feeder 3 is provided on the original cover 1. In case the center of gravity 2 should unavoidably be placed at either the right or left of the original cover 1 because of a geometrical relation between the original cover 1 and automatic document feeder 3, there must be provided an original cover closer A of one type destined to keep the original cover 1 at an intermediate opened angle and prevent it from falling abruptly and in addition an original cover closer B of another type destined to well balance the right and left of the original cover 1 and thus facilitate a smooth operation of the original cover 1 when closed or opened.

SUMMARY OF THE INVENTION

To overcome the drawbacks of the prior art and realize the above concept, the present invention seeks to provide an original cover closer for a copying machine, having an assistive function of original cover operation as included in the concept of the present invention, means for adjusting the installed position of the closer as will be described later, and also a function of lifting the original cover.

The present invention has another object to provide an original cover closer set comprising, in combination, the above-mentioned assistive original cover closer of one type, and an original cover closer of another type adapted to hold the original cover at an intermediate opened angle and prevent the original cover from falling abruptly.

The above object can be achieved by providing an original cover closer of one type used on a copying machine to support closably and openably an original cover on which an automatic document feeder is provided, comprising:

a mounting member to be fixed on the copying machine body;

a supporting member for closably and openably supporting the original cover pivoted only at one side thereof to the mounting member;

a lifting member supported only at one side thereof on a free end of the supporting member pivotably in an opposite direction to the pivoting direction of the supporting member; and an extension coil spring provided extending between the lifting member or original cover and the mounting member to pull the lifting member towards the supporting member to a position where the lifting member overlaps the supporting member.

The above object can also be achieved by providing an original cover closer set adapted to support an original cover used on a copying machine and on which an automatic document feeder is additionally provided, including two types of original cover closers different in construction from each other;

one of the two types, comprising:

a mounting member to be fixed on the copying machine body;

a supporting member pivoted only at one side thereof to he mounting member; and a resilient member provided between the mounting member and free end of the supporting member pivoted to the mounting member to support the original cover and act in such a direction as to cancel the weight of the original cover; and the other type including no resilient member provided between the mounting and supporting members.

The above object can also be achieved by providing an original cover closer set adapted to support an original cover used on a copying machine and on which an automatic document feeder is additionally provided, including two types of original cover closers different in construction from each other;

one of the two types, comprising:

a mounting member to be fixed on the copying machine body;

a supporting member pivoted only at one side thereof to the mounting member to support the original cover closably and openably;

a lifting member supported only at one side thereof on a free end of the supporting member pivotably in an opposite direction to the pivoting direction of the supporting member; and a compression coil spring provided extending between the lifting member or original cover and the mounting member or the supporting member to pull the lifting member towards the supporting member to a position where the lifting member overlaps the supporting member;

the other type, comprising:

a mounting member to be installed on the copying machine body;

a supporting member pivoted to both side plates of the mounting member to support the original cover closably and openably;

a resilient member provided between the mounting member and free end of the supporting member to force the supporting member in the opening direction of the original cover;

a lifting member supported on a free end of the supporting member pivotably in a direction opposite to the pivoting direction of the supporting member and to which the original cover is secured; and a controlling member provided between the supporting member and the original cover or lifting member to control the motion of the original cover or lifting member in relation to the supporting member during normal operation.

Also the above object can be achieved by providing an original cover closer set comprising two types of original cover closers, of which either or both comprises means for leveling the original cover in relation to a contact glass of the copying machine.

The above object can also be achieved by providing an original cover closer set comprising two types of original cover closers, of which either or both comprises means for adjusting the parallelism of the original cover.

BRIEF DESCRIPTION OF THE DRAWINGS

These objects and other objects, features, aspects and advantages of the present invention will become more apparent from the following detailed description of the present invention when taken in conjunction with the accompanying drawings, of which.

DETAILED DESCRIPTION OF THE PREFERRED EMBODIMENTS

Figure 1:
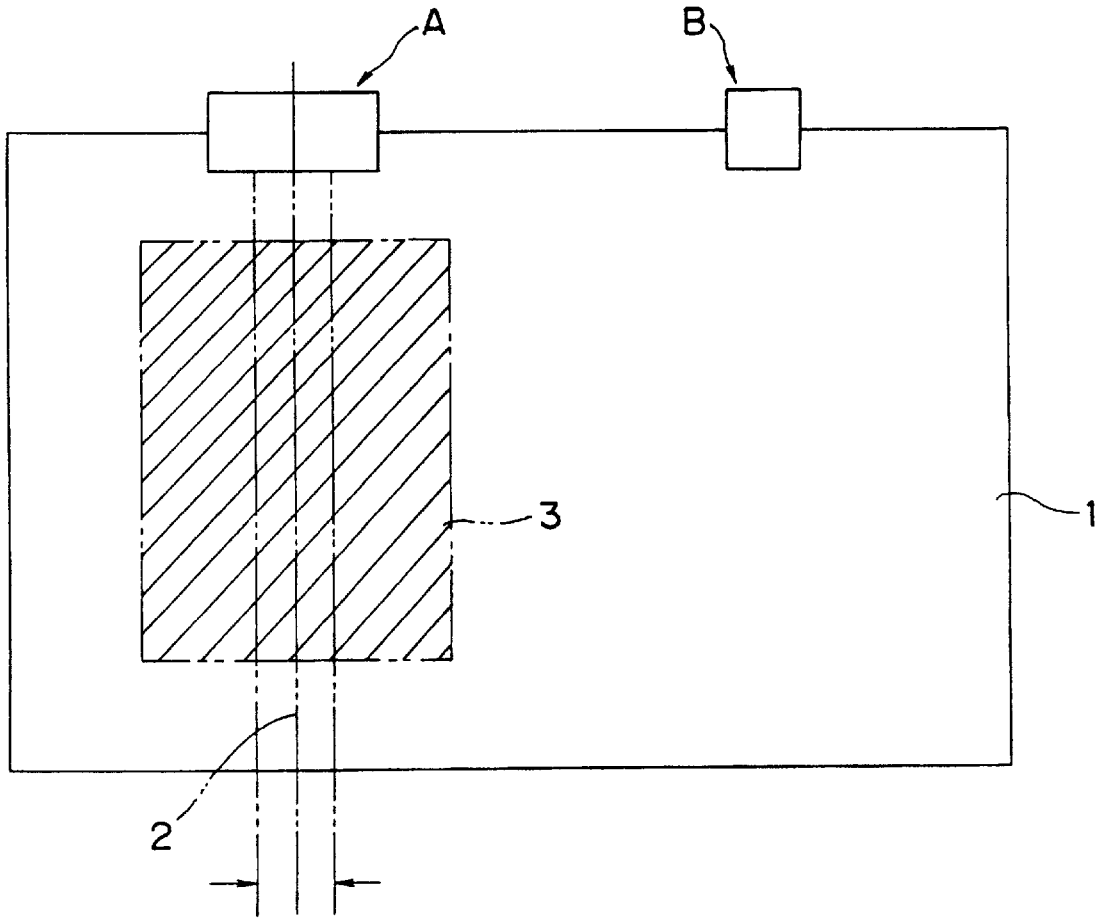
FIG. 1 is an explanatory drawing showing the concept of the present invention.
Figure 2:
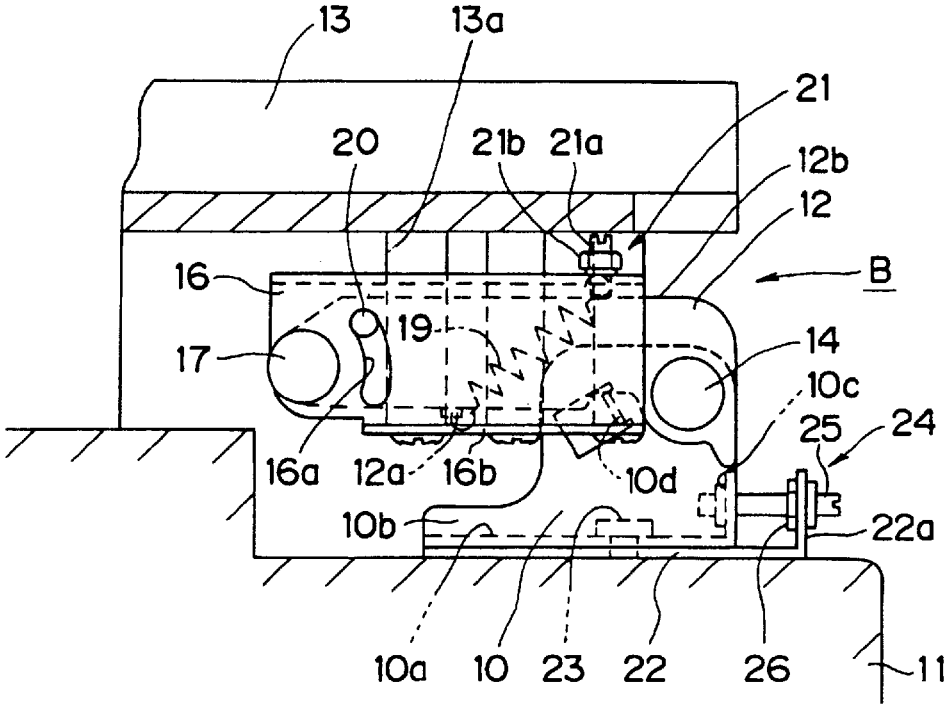
FIG. 2 is a side elevation of an original cover closer B of one type according to the present invention.
Figure 3:
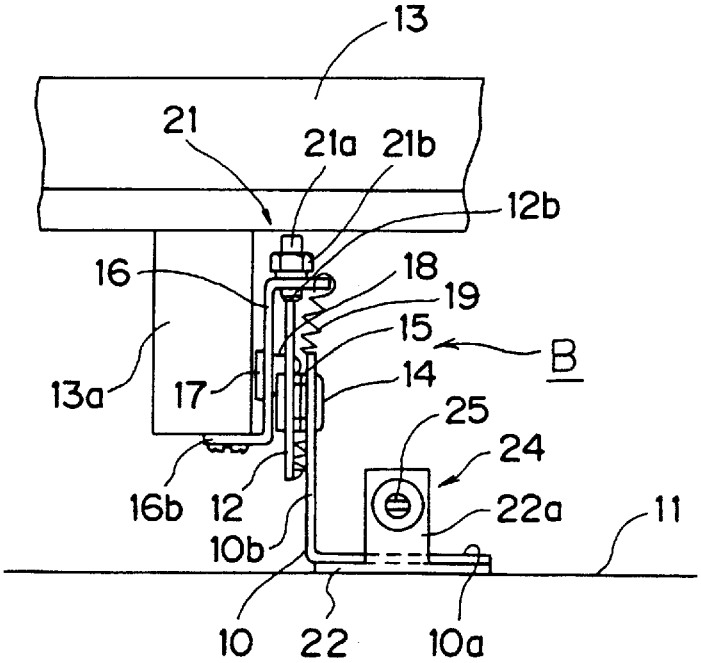
FIG. 3 is a rear view of the original cover closer B in FIG. 2.
Figure 4:
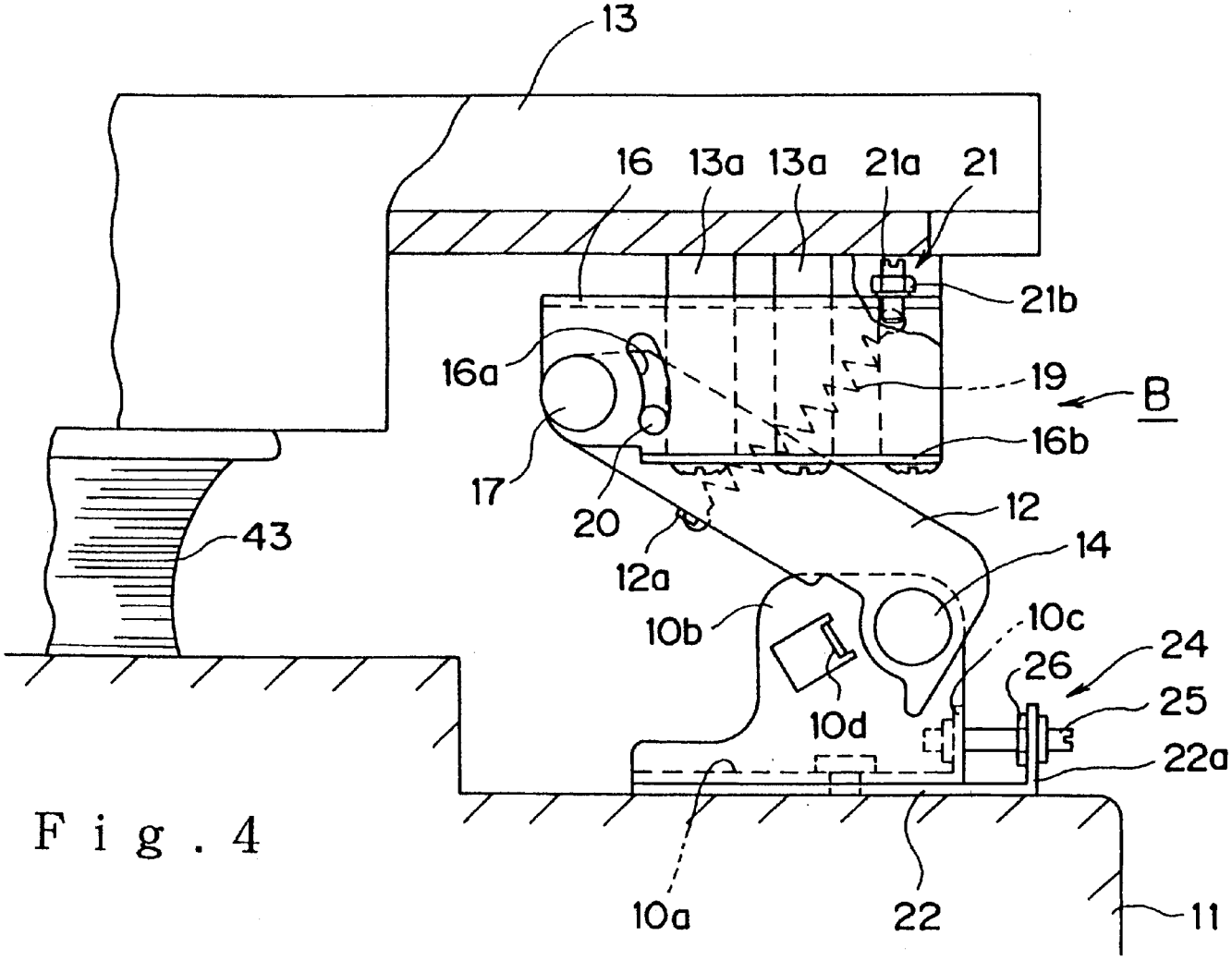
FIG. 4 is a drawing for explanation of the operations of the original cover closer B in FIG. 2.

Referring now to FIGS. 2 to 4, there is illustrated an embodiment of the auxiliary original cover closer B according to the present invention. The original cover closer will be referred to simply as "closer" hereinunder. The closer B comprises a mount bracket 10 consisting of a mount plate 10*a* and a bearing plate 10*b*, formed to have a substantially L-shaped cross section. The mount plate 10*a* is slidably mounted, with a set button 23, on an adjusting bracket 22 fixed on a copying machine body 11. The adjusting bracket 22 is provided with a mechanism 24 for parallel movement of the mount bracket 10 on the adjusting bracket 22. The mechanism 24 includes a moving piece 10*c* projected from the back of the mount bracket 10, a stationary piece 22*a* projected from the adjusting bracket 22, a screw 25 extending through the moving and stationary pieces 10*a* and 22*a*, and a nut 26. Note that the parallel movement mechanism 24 may be provided on the main closer A which will be described later with reference to FIGS. 5 to 7. As the screw 25 is rotated clockwise or counterclockwise with a screwdriver, the mount bracket 10 is slid backward or forwards.

Further, the closer B comprises a support plate 12 to support an original cover 13. The support plate 12 is pivotably supported on the bearing plate 10*b* by means of a cylindrical bearing member (not shown) secured to the bearing plate 10*b* and a first hinge pin 14 having a large diameter and inserted through the bearing member. The support plate 12 is thus supported only at one side thereof on the bearing plate 10*b* of the mount bracket 10 pivotably in a same direction as the original cover 13 when opened or closed. There is provided between the support plate 12 and bearing plate 10*b* of the mount bracket 10 a friction plate 15 through the center of which the first hinge pin 14 is penetrated. The hinge pint 14 is caulked at one end thereof to generate a friction torque.

The closer B further comprises a lifting plate 16 formed, by bending, to have a substantially crank-shaped cross section. The lifting plate 16 is pivotably supported on the support plate 12 by means of a cylindrical bearing member (not shown) secured to the other free end of the bearing plate 10*b* and a second hinge pin 17 having a large diameter and inserted through the bearing member. The lifting plate 16 is thus supported only at one side thereof on the mount bracket 10 pivotably in an opposite direction to the pivoting direction of the support plate 12 when the original cover 13 is opened or closed. There is also provided between the support plate 12 and lifting plate 16 a friction plate 18 through the center of which the second hinge pin 17 is penetrated. The second hinge pin 17 is caulked at one end thereof to generate a friction torque at a portion where the lifting plate 16 is pivoted to the support plate 12.

Also the closer B comprises an extension coil spring 19 provided between one of a plurality of retention holes (not shown) formed in the lifting plate 16 and a retention piece 12*a* formed on the support plate 12. The coil spring 19 always pulls the lifting plate 16 in such a direction that the lifting plate 16 will overlap the support plate 12. The support plate 12 further has formed thereon a guide pin 20 which is fitted in a guide recess 16*a* formed in the lifting plate 16.

The closer B further comprises a leveling member 21 for the original cover 13. The leveling member 21 consists of a screw 21*a* screwed in the lifting plate 16 and whose end abuts a top 12*b* of the support plate 12, and a nut 21*b* engaged on the screw 21*a*. The lifting plate 16 has a fixing piece 16*b* to which fixtures 13*a* of the original cover 13 are secured. The mount bracket 10 has provided on the bearing plate 10*b* a stopper 10*d* which abuts to stop the support plate 12.

In the aforementioned embodiment, the extension coil spring 19 extending between the support plate 12 and lifting plate 16 enables the lifting plate 16 to pivot smoothly towards the support plate 12. Note however that the coil spring 19 may be omitted, which will contribute to a reduced number of parts of the closer B.

Figure 5:
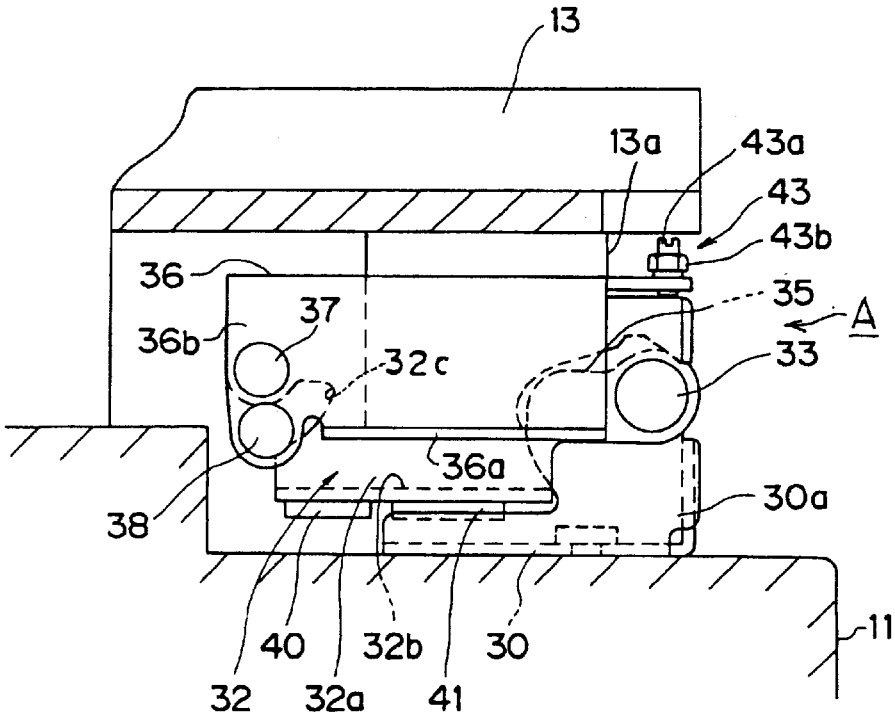
FIG. 5 is a side elevation of an original cover closer A of another type according to the present invention.
Figure 6:
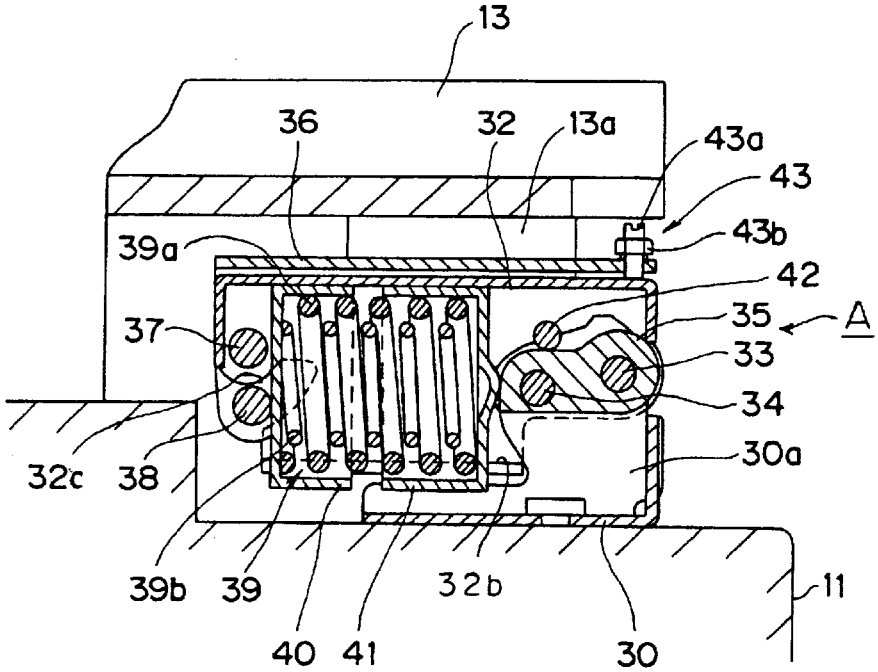
FIG. 6 is a sectional view of the original cover closer A in FIG. 5.
Figure 7:
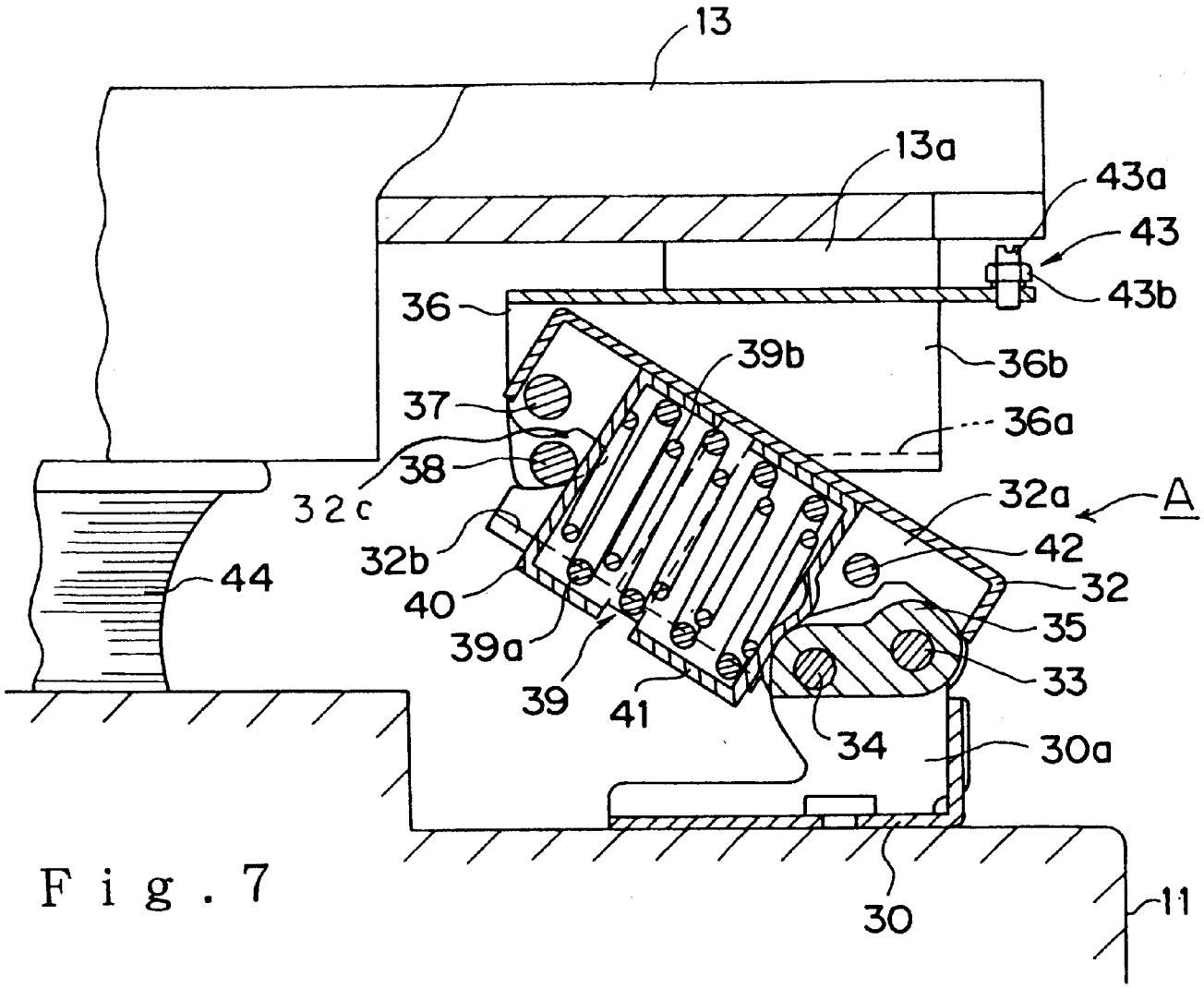
FIG. 7 is a drawing for explanation of the operations of the original cover closer A in FIG. 5.

Referring next to FIGS. 5 to 7, there is illustrated an embodiment of the original cover closer B different in construction from the embodiment of the closer A having been described in the foregoing. Also the original cover closer will be referred to simply as "closer" hereinunder.

The closer A comprises a mounting member 30 formed to have a substantially C-shaped cross section, and a supporting member 32 formed to have a substantially C-shaped cross section. The mount bracket 30 consists of two side plates 30*a*, and it is to be fixed on a copying machine body 11. The supporting member 32 consists of two side plates 32*a* and two inward projections 32*b* extending from the respective lower ends of the side plates 32*a*. The supporting member 32 is pivoted to the side plates 32*a* thereof on the respective side plates 30*a* of the mounting member 30 with a first hinge pin 33. There are fitted on the first hinge pin 33 a friction washer and a spring washer (not shown) in pair at each coupling between the side plates 30*a* and 32*a*. The first hinge pin 33 is caulked at the end thereof to generate a friction. Further, a cam 35 is secured with the first hinge pin 33 and a fixing pin 34 to each side plate 30*a* of the mounting member 30.

The closer A further comprises a lifting member 36 provided at free ends of the side plates 32*a* of the supporting member 32. The lifting member 36 comprises a pair of outward projections 36*a* and a pair of side plates 36*b* from the respective lower ends of which the outward projections 36*a* extend. The lifting member 36 is supported at one end thereof on the supporting member 32 by means of a second hinge pin 37 pivotably in an opposite direction to the pivoting direction of the support plate 12 when the original cover 13 is opened or closed. An actuator pin 38 is provided in a position away from the second hinge pin 37 coupling the side plates 36*b* of the lifting member 36 to the respective side plates 32*a* of the supporting member 32. Fixtures 13*a* of the original cover 13 (only one of them is illustrated) are secured to the end plates 36*a,* respectively, of the lifting member 36.

Further the closer B comprises a resilient member 39 consisting of compression coil springs 39*a* and 39*b*. The resilient member 39 is housed in a pair of cylindrical sliders 40 and 41 slidably held on the inward projections 32*b* of the supporting member 32. That is, the resilient member 49 is provided between the actuator pin 38 on the lifting member 36 and the cam 35 on the mounting member 30 in a space defined by the cylindrical sliders 40 and 41. Near the cam 35, a stopper pin 42 is provided on the side plate 32*a* of the supporting member 32 to abut and stop the slider 41.

The closer B further comprises a leveling member 43 for the original cover 13. The leveling member 43 consists of a screw 43*a* screwed in the lifting plate 36 and whose end abuts a top of the supporting member 32, and a nut 43*b* engaged on the screw 21*a*. Note that the leveling member 43 may be adapted for the end of the screw 43*a* to abut the first hinge pin 33 or mounting member 30 through a hole (not shown) formed in the supporting member 32 or the screw 43*a* may be installed in parallel to the lifting member 36 or supporting member 32 to be inserted at the end thereof between the lifting member 36 and supporting member 32. This is also true for the aforementioned closer B.

The closer B constructed as having been described in the foregoing functions as will be described below:

When an original is thin like a sheet of paper, the original cover 13 opened or closed, without reverse over the opening or closing stroke, under the effect of the resilient member 39 consisting of the compression coil springs 39*a* and 39*b* provided between the lifting member 36 and mounting member 30. It is stably held stopped at a predetermined opened angle by the slider 41 abutting the cam 35.

When the original is thick like a book as indicated with a reference 44, however, the original cover 13 is applied to the thick original 44 as shown in FIG. 7. When the original cover 13 is depressed with some force at the near side thereof, the actuator pin 38 will push the resilient member 39. Against the resilience of the member 39, the lifting member 36 will be turned in an opposite direction to the closing direction of the original cover 13 so that the original cover 13 can horizontally cover the top of the thick original 44 as shown in FIG. 7. Namely, when the original cover 13 is depressed as in the above, the actuator pin 38 will slide into cuts 32*c* (only one of them is illustrated) formed in the side plates 32*a* of the supporting member 32 so that the lifting member 36 is allowed to move in the above-mentioned direction. When the thick original 44 is removed, the original cover 13 will automatically be returned to the home position by the lifting member 36 under the resilience of the resilient member 39. At the home position, the lifting member 36 overlaps the supporting member 32.

In case the closers A and B are used in combination, when the lifting member 36 of the closer A is turned in an opposite direction to the closing direction of the original cover 13, the lifting plate 16 of the closer B is also moved in that direction, so that the original cover 13 can horizontally cover the top of the thick original 44. When the thick original 44 is removed, the original cover 13 is pulled and returned to the home position by the extension coil spring 19. It will be of course appreciated that in a combination of the closers A and B, the spring 19 of the closer B may be omitted. Since the closers A and B cooperate with each other, when the lifting member 36 of the closer A returns to its initial position, the lifting plate 16 of the closer B can also return to its initial position even without the spring 19. However, the existence of the spring 19 will assure the positive operation of the closer B.

As having been described in the foregoing, the closer A has the resilient member 39 consisting of the compression coil spring 39*a* and 39*b* and provided between the cam 35 on the mounting member 30 and the actuator pin 38 on the lifting member 36 in the space defined by the cylindrical sliders 40 and 41 held on the supporting member 32. Note however that the resilient member 39 may be supported on a spring receiver pivoted in a position off the hinge pin 33.

Although the compression coil springs 39*a* and 39*b,* having different diameters, large and small, are used one inside the other in the closer B as described above, they may be of a same diameter and used side by side in the closer B.

In the leveling members 21 and 43 for the original cover 13, the screw 21*a* (43*a*) is rotated (tightened or loosened) to tilt the lifting plate 16 (lifting member 36) about the second hinge pin 17 (37), thereby leveling the original cover 13. The leveling member 21 (43) is used to level the original cover 13 as in the above so that the original cover 13 can be placed in horizontal contact with the contact glass of the copying machine so that the paper feed rollers of a document feeder, if any, can also have a horizontal contact with the contact glass. In this case, the leveling member keeps the original from being distorted or deflected while it is being fed on the contact glass.

The mechanism 24 provided in the closer B for parallel movement of the mount bracket 10 on the adjusting bracket 22 is provided to position the mount bracket 10 so that the paper feed rollers of an automatic document feeder, if any, are orthogonal to the paper feeding direction. By rotating (tightening or loosening) the screw 25, the mount bracket 10 of the closer B is displaced for the rollers of the automatic document feeder to have an orthogonal position to the paper feeding direction.

Also note that the sliders 40 and 41 of the closer A may be slidably held on the supporting member 32 by a concavity-convexity fitting or cut-projection engagement between the inward projections 32*b* of the supporting member 32 and the lateral sides of the sliders 40 and 41.

What is claimed is:

1. An original cover closer adapted to support an original cover used on a copying machine and on which an automatic document feeder is additionally provided, including two types of original cover closers different in construction from each other;

one of the two types, comprising:

a mounting member to be fixed on the copying machine body;

a supporting member pivoted only at one side thereof to the mounting member to support the original cover closably and openably;

a lifting member supported only at one side thereof on a free end of the supporting member pivotably in an opposite direction to the pivoting direction of the supporting member; and a resilient member provided between the mounting member and free end of the supporting member pivoted to the mounting member to support the original cover and act in such a direction as to cancel the weight of the original cover; and the other type of original cover closer including said one type of closer having no resilient member provided between the mounting and supporting members.

2. The original cover closer set as set in claim 1, wherein either or both of the two types of original cover closers comprises means for leveling the original cover in relation to a contact glass of the copying machine;

the means for leveling the original cover, comprising:

a screw mounted on either the lifting member, supporting member, hinge pin, or mounting member for adjusting a distance between the lifting member and the supporting member; and a nut engaged on the screw.

3. The original cover closer set as set in claim 1, wherein either or both of the two types of original cover closers comprises means for adjusting the parallelism of the original cover;

the means for adjusting the parallelism of the original cover, comprising:

an adjusting bracket fixed on the copying machine body;

the mount bracket or mounting member slidably mounted on the adjusting bracket by a set button;

a screw mounted on between a stationary piece of the adjusting bracket and a moving piece of the mount bracket or mounting member for sliding the mount bracket or mounting member; and a nut engaged on the screw.

4. An original cover closer set adapted to support an original cover used on a copying machine and on which an automatic document feeder is additionally provided, including two types of original cover closers different in construction from each other;

one of the two types, comprising:

a mounting member to be fixed on the copying machine body;

a supporting member pivoted only at one side thereof to the mounting member to support the original cover for closably and openably;

a lifting member supported only at one side thereof on a free end of the supporting member pivotably in an opposite direction to the pivoting direction of the supporting member; and a compression coil spring provided extending between the lifting member or original cover and the mounting member or the supporting member to pull the lifting member towards the supporting member to a position where the lifting member overlaps the supporting member;

the other type, comprising:

a mounting member to be installed on the copying machine body;

a supporting member pivoted to both side plates of the mounting member to support the original cover closably and openably;

a resilient member provided between the mounting member and free end of the supporting member to force the supporting member in the opening direction of the original cover;

a lifting member supported on a free end of the supporting member pivotably in an opposite direction to the pivoting direction of the supporting member and to which the original cover is secured; and a controlling member provided between the supporting member and the original cover or lifting member to control the motion of the original cover or lifting member in relation to the supporting member during normal operation.

5. The original cover closer set as set in claim 4, wherein either or both of the two types of original cover closers comprises means for leveling the original cover in relation to a contact glass of the copying machine;

the means for leveling the original cover, comprising:

a screw mounted on either the lifting member, supporting member, hinge pin, or mounting member for adjusting a distance between the lifting member and the supporting member; and a nut engaged on the screw.

6. The original cover closer set as set in claim 4, wherein either or both of the two types of original cover closers comprises means for adjusting the parallelism of the original cover;

the means for adjusting the parallelism of the original cover, comprising:

an adjusting bracket fixed on the copying machine body;

the mount bracket or mounting member slidably mounted on the adjusting bracket by a set button;

a screw mounted on between a stationary piece of the adjusting bracket and a moving piece of the mount bracket or mounting member for sliding the mount bracket or mounting member; and a nut engaged on the screw.

7. An original cover closer set adapted to support an original cover used on a copying machine and on which an automatic document feeder is additionally provided, including two types of original cover closers different in construction from each other;

one of the two types, comprising:

a mounting member to be fixed on the copying machine body;

a supporting member pivoted only at one side thereof to the mounting member to support the original cover for closably and openably;

a lifting member supported only at one side thereof on a free end of the supporting member pivotably in an opposite direction to the pivoting direction of the supporting member; and a compression coil spring provided extending between the lifting member or original cover and the mounting member or the supporting member to pull the lifting member towards the supporting member to a position where the lifting member overlaps the supporting member;

the other type, comprising:

a mounting member to be fixed on the copying machine body;

a supporting member pivoted only at one side thereof to the mounting member to support the original cover closably and openably;

a lifting member supported only at one side thereof on a free end of the supporting member pivotably in an opposite direction to the pivoting direction of the supporting member; and an extension coil spring provided extending between the lifting member or original cover and the mounting member to pull the lifting member towards the supporting member to a position where the lifting member overlaps the supporting member.

8. The original cover closer set as set in claim 7, wherein either or both of the two types of original cover closers comprises means for leveling the original cover in relation to a contact glass of the copying machine;

the means for leveling the original cover, comprising:

a screw mounted on either the lifting member, supporting member, hinge pin, or mounting member for adjusting a distance between the lifting member and the supporting member; and a nut engaged on the screw.

9. The original cover closer set as set in claim 7, wherein either or both of the two types of original cover closers comprises means for adjusting the parallelism of the original cover;

the means for adjusting the parallelism of the original cover, comprising:

an adjusting bracket fixed on the copying machine body;

the mount bracket or mounting member slidably mounted on the adjusting bracket by a set button;

a screw mounted on between a stationary piece of the adjusting bracket and a moving piece of the mount bracket or mounting member for sliding the mount bracket or mounting member; and a nut engaged on the screw.

* * * * *